US006254177B1

(12) United States Patent
Tseng

(10) Patent No.: US 6,254,177 B1
(45) Date of Patent: Jul. 3, 2001

(54) FOLDABLE CHAIR FRAME

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/704,962

(22) Filed: Nov. 2, 2000

(51) Int. Cl.[7] ..... A47C 4/44

(52) U.S. Cl. ..... 297/54; 248/440; 297/16.1; 108/125

(58) Field of Search ..... 297/16.1, 54; 108/121, 108/125; 248/432, 440

(56) References Cited

U.S. PATENT DOCUMENTS 897,737 * 9/1908 Goodrich ..... 297/54
2,011,251 * 8/1935 Michelson ..... 408/121 X
3,464,373 * 9/1969 Larson ..... 108/125

FOREIGN PATENT DOCUMENTS

762820 * 4/1934 (FR) ..... 297/54

* cited by examiner

*Primary Examiner*—Peter R. Brown
(74) *Attorney, Agent, or Firm*—Ladas & Parry

(57) ABSTRACT

A foldable chair frame includes a linking unit for connecting foldably a leg member to a seat member of the chair frame. The linking unit includes a first linking plate with an upper end pivoted to the seat member, a second linking plate with a lower end pivoted to the leg member, a resilient locking plate with an upper end pivoted to the seat member, and a locking pin extending through an elongated hole in the locking plate. The locking pin interconnects foldably adjacent ends of the first and second linking plates, and has a narrower pin section slidable along the elongated hole during pivoting movement of the first and second linking plates relative to each other. The locking pin further has a wider pin section which engages an enlarged hole end of the elongated hole when the first and second linking plates are unfolded from each other for locking the first and second linking plate at an unfolded state. The locking plate is depressible for disengaging the wider pin section from the enlarged hole end so as to permit folding of the first and second linking plates relative to each other.

5 Claims, 7 Drawing Sheets

FOLDABLE CHAIR FRAME

BACKGROUND OF THE INVENTION

1. Field of the Invention

The present invention relates to a foldable chair frame, more particularly to a foldable chair frame provided with a locking unit for locking the chair frame at an unfolded state so as to prevent untimely folding of the chair frame.

2. Description of the Related Art

FIG. 1 shows a conventional chair frame 1 which includes a generally horizontal seat member 11, a front leg member 13 with an upper end pivoted to a front portion of the seat member 11 by means of a front pivot axle 12, and a rear leg member 14 with an upper end pivoted to a rear portion of the seat member 11 by means of a rear pivot axle 12'. A front linking unit 15 and a rear linking unit 15' are disposed between the front and rear leg members 13, 14 for connecting foldably the front and rear leg members 13, 14 to the seat member 11 such that the front leg member 13 is foldable rearwardly toward the seat member 11 and such that the rear leg member 14 is foldable forwardly toward the seat member 11. As shown in FIG. 2, each of the front and rear linking units 15, 15' includes a first linking plate 151 having an upper end pivoted to the seat member 11 by means of a horizontal first pivot pin 154, and a second linking plate 152 having an upper end pivoted to a lower end of the first linking plate 151 by means of a horizontal second pivot pin 153 and a lower end pivoted to an intermediate section of a respective one of the front and rear leg members 13, 14 by means of a horizontal third pivot pin 154'. The lower end of the first linking plate 151 is formed with a stop projection 155 for engaging an engaging groove 156 formed in the upper end of the lower linking plate 152 so as to limit further pivoting movement between the first and second linking plates 151, 152 when the first and second linking plates 151, 152 are unfolded from each other (see FIG. 1). By unfolding the first and second linking plates 151, 152 from each other, the respective one of the front and rear leg members 13, 14 can be unfolded from the seat member 11. To fold the chair frame 1, the juncture portions of the first and second linking plates 151, 152 are pushed upwardly to disengage the stop projection 155 from the engaging groove 156 and to result inpivoting movement of the first and second linking plates 151, 152 relative to each other, thereby folding the front or rear leg member 13, 14 toward the seat member 11.

However, since the first and second linking plates 151, 152 are not locked to each other at the unfolded state, it is likely that the front and rear leg members 13, 14 might be untimely folded toward the seat member 11. This could happen when the chair frame 1 is disposed on an uneven ground surface, such as on the beach. As such, user safety cannot be ensured.

SUMMARY OF THE INVENTION

Therefore, the main object of the present invention is to provide a foldable chair frame having a locking unit for locking the chair frame at an unfolded state to prevent untimely folding of the same.

Accordingly, the foldable chair frame of the present invention includes a generally horizontal seat member, front and rear leg members, and front and rear linking units. The front leg member has an upper end pivoted to the seat member at a horizontal front pivot axis, a lower end adapted to be supported on a ground surface, and an intermediate portion between the upper and lower ends. The front leg member is foldable rearwardly toward the seat member about the front pivot axis. The rear leg member is disposed rearwardly of the front leg member, and has an upper end pivoted to the seat member at a horizontal rear pivot axis parallel to the first pivot axis, a lower end adapted to be supported on a ground surface, and an intermediate portion between the upper and lower ends of the rear leg member. The rear leg member is foldable forwardly toward the seat member about the rear pivot axis. The front and rear linking units are disposed between the front and rear leg members. Each of the front and rear linking units includes first and second linking plates, a resilient locking plate, and a locking pin. The first linking plate has an upper end pivoted to the seat frame, and a lower end formed with a first pivot hole. The second linking plate has an upper end formed with a second pivot hole aligned with the first pivot hole, and a lower end pivoted to the intermediate portion of a respective one of the front and rear leg members. The locking plate has a pivoting end portion pivoted to the seat member and the upper end of a respective one of the front and rear leg members at a respective one of the front and rear pivot axes, an operating end portion opposite to the pivoting end portion, and an inclined section between the pivoting end portion and the operating end portion and formed with an elongated hole that has an enlarged hole end proximate to the operating end portion. The inclined section is inclined relative to the pivoting end portion and the operating end portion so as to dispose the pivoting end portion and the operating end portion in different vertical planes. The locking pin extends through the elongated hole in the locking plate and through the first and second pivot holes in the first and second linking plates for interconnecting foldably the first and second linking plates. The locking pin has a thinner pin section slidable along the elongated slot and a wider pin section for engaging the enlarged hole end of the elongated hole. The locking pin is movable in the elongated hole so as to engage the wider pin section of the locking pin with the enlarged hole end of the elongated hole when the respective one of the front and rear leg members is unfolded from the seat member, thereby positioning the first and second linking plates at an unfolded state relative to each other, and thereby positioning the respective one of the front and rear leg members at an unfolded state relative to the seat member. The operating end portion of the locking plate is operable to align the enlarged hole end of the elongated hole with the narrower pin section of the locking pin so as to disengage the wider pin section from the enlarged hole end and to permit movement of the locking pin along the elongated hole for folding the first and second linking plates toward each other, thereby folding the respective one of the front and rear leg members toward the seat member.

BRIEF DESCRIPTION OF THE DRAWINGS other features and advantages of the present invention will become apparent in the following detailed description of the preferred embodiment with reference to the accompanying drawings, of which:

DETAILED DESCRIPTION OF THE PREFERRED EMBODIMENT

Figure 1:
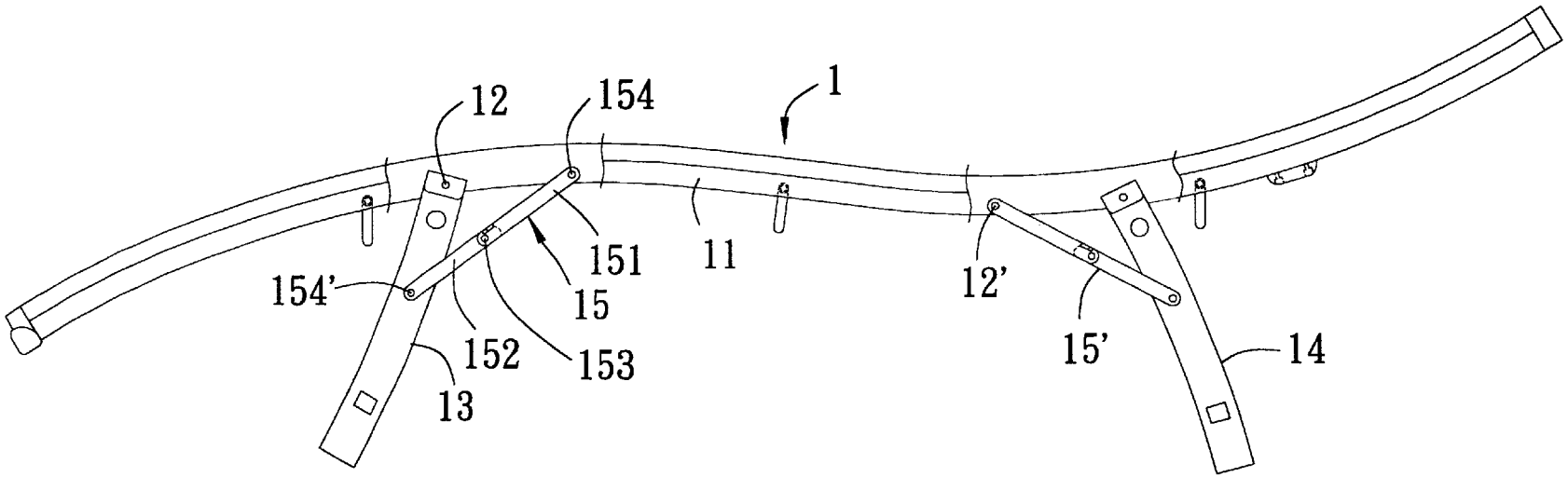
FIG. 1 PRIOR ART
FIG. 1 is a schematic side view of a conventional chair frame.
Figure 2:
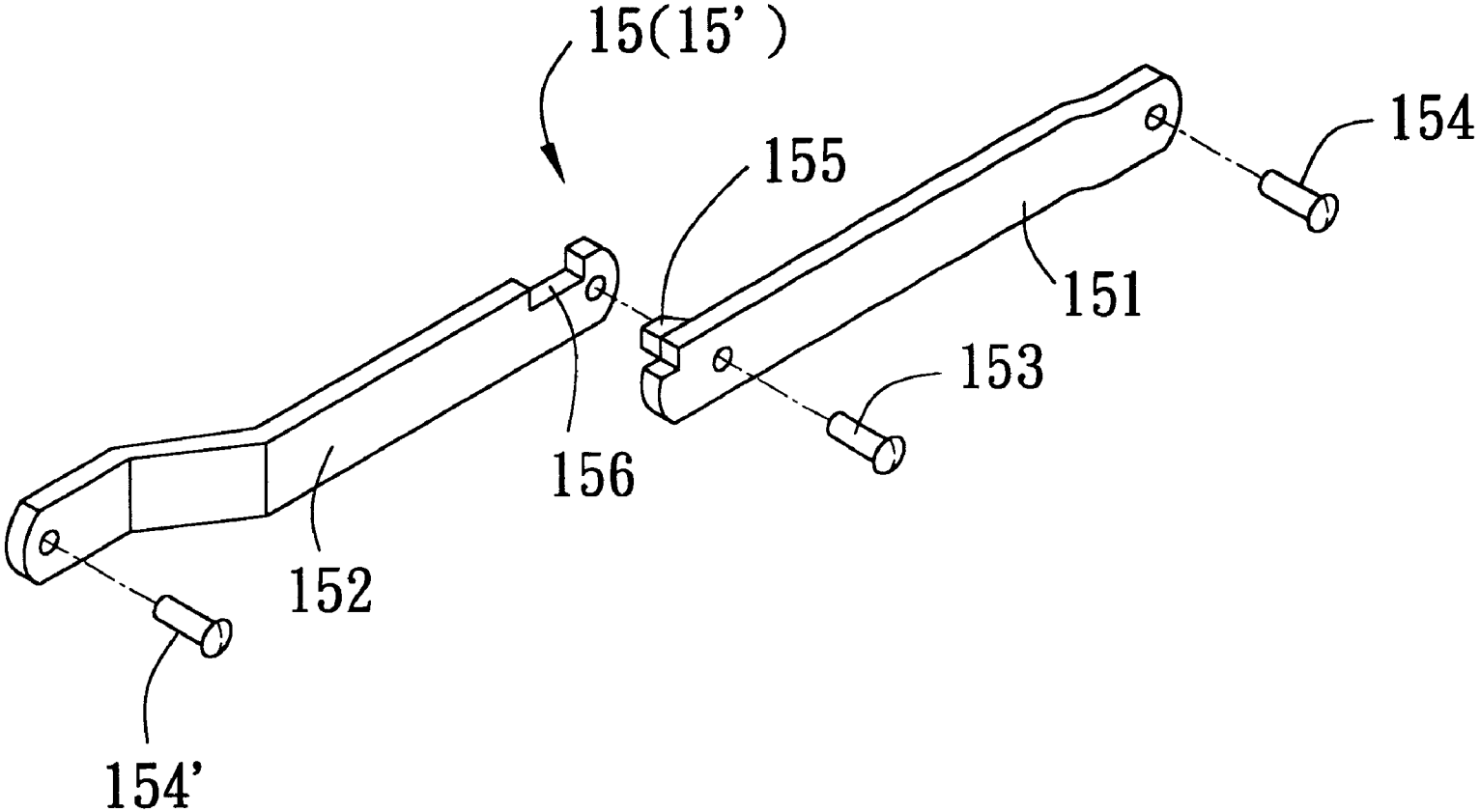
FIG. 2 PRIOR ART
FIG. 2 is an exploded perspective view illustrating a linking unit of the conventional chair frame of FIG. 1.
Figure 3:
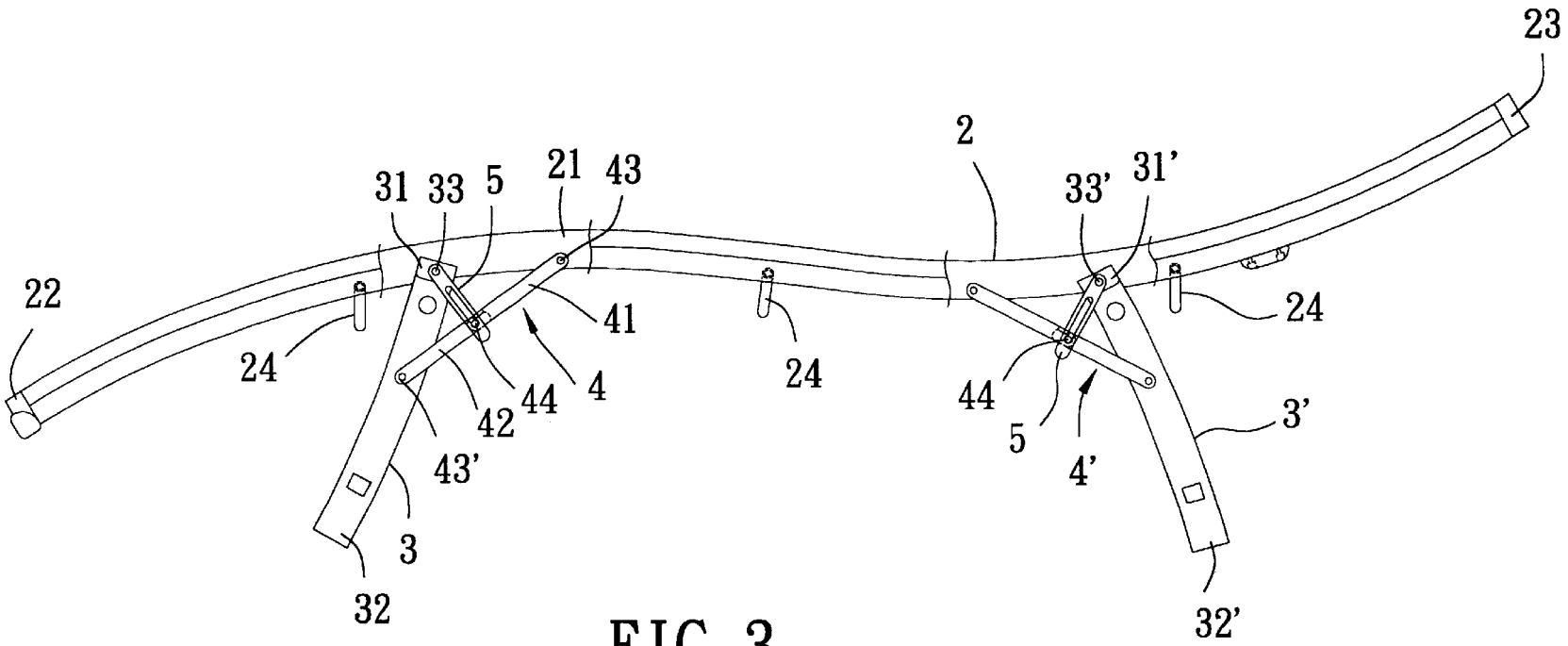
FIG. 3 is a schematic side view of a preferred embodiment of the foldable chair frame of the present invention.
Figure 4:
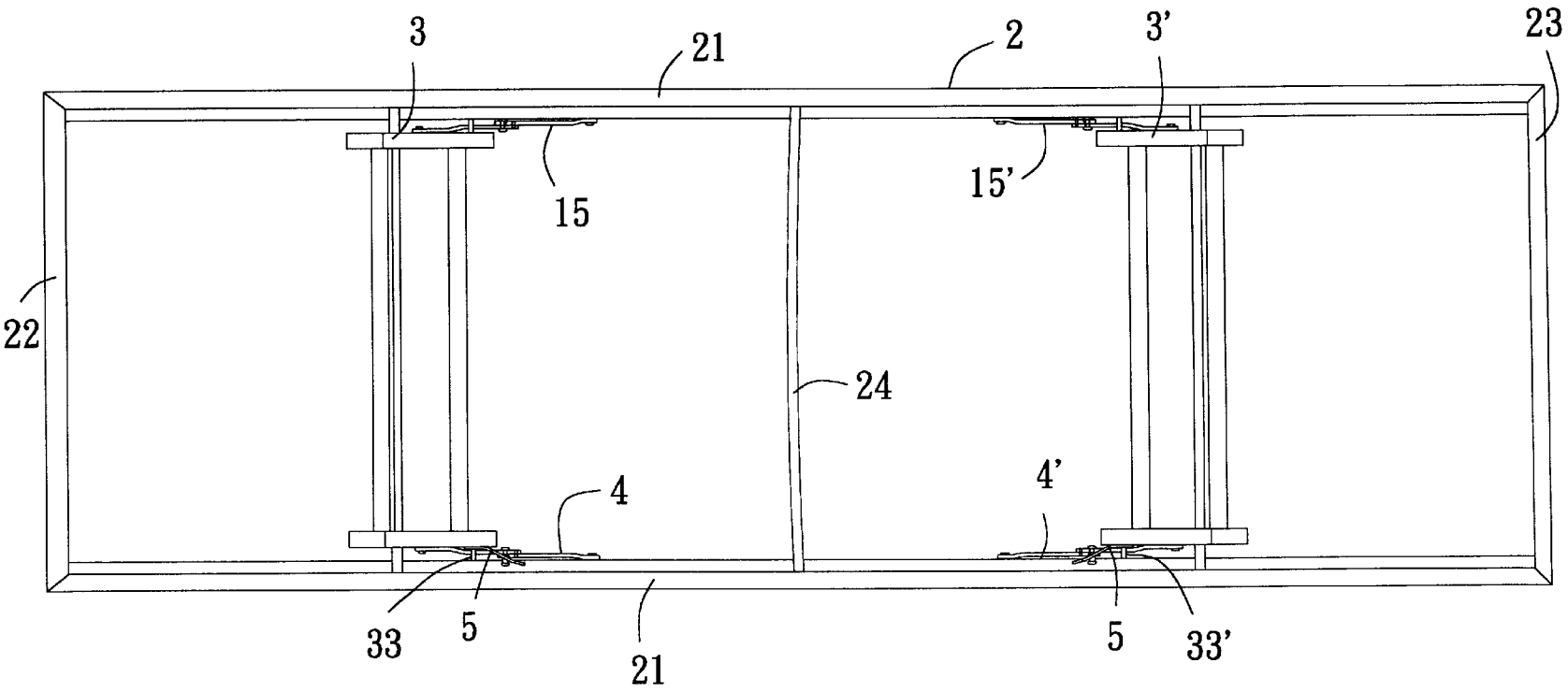
FIG. 4 is a bottom view of the preferred embodiment.

Referring to FIGS. 3 and 4, the preferred embodiment of the foldable chair frame of the present invention is shown to include a seat member 2, a front leg member 3, a rear leg member 3', a front linking unit 4, and a rear linking unit 4'.

The seat member 2 is disposed in a generally horizontal orientation, and includes a parallel pair of lateral rods 21, and several transverse connecting rods 22, 23, 24 interconnecting the lateral rods 21.

The front leg member 3 has an upper end 31 pivoted to a front portion of the seat member 2 on the lateral rods 21 by means of a pair of front pivot axles 33, and a lower end adapted to be supported on a ground surface. The rear leg member 3' has an upper end 31' pivoted to a rear portion of the seat member 2 on the lateral rods 21 by means of a pair of rear pivot axles 33', and a lower end 32' adapted to be supported on the ground surface.

Figure 5:
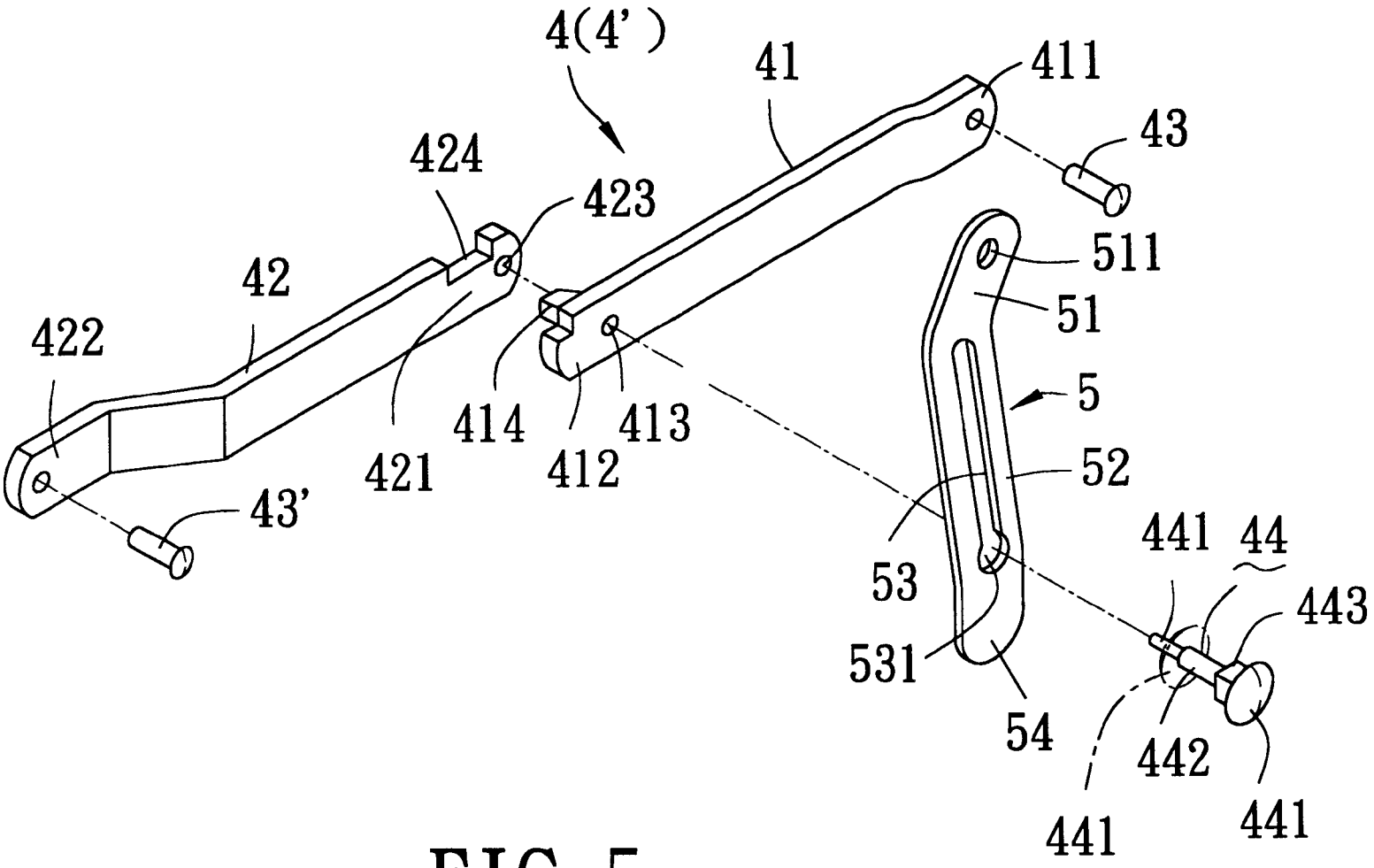
FIG. 5 is an exploded perspective view illustrating a linking unit of the chair frame of the preferred embodiment.

Referring to FIGS. 3 and 5, the front and rear linking units 4, 4' are disposed adjacent to one of the lateral rods 21 and between the front and rear leg members 3, 3', and are adjacent to the front and rear leg members 3, 3', respectively. Each of the front and rear linking units 4, 4' includes parallel first and second linking plates 41, 42, a resilient locking plate 5, and a locking pin 44. The first linking plate 41 has an upper end 411 pivoted to one of the lateral rods 21 of the seat member 2 by means of a horizontal first pivot shaft 43 parallel to the front pivot axle 33, and a lower end formed with a first pivot hole 413 and a stop projection 414. The second linking plate 42 has a lower end 422 pivoted to the intermediate portion of a respective one of the front and rear leg members 3, 3' by means of a horizontal second pivot shaft 43' parallel to the first pivot shaft 43. The second linking plate 42 further has an upper end 421 formed with a second pivot hole 423 aligned with the first pivot hole 413 in the first linking plate 41, and an engaging groove 424 for engaging the stop projection 414.

Figure 6:
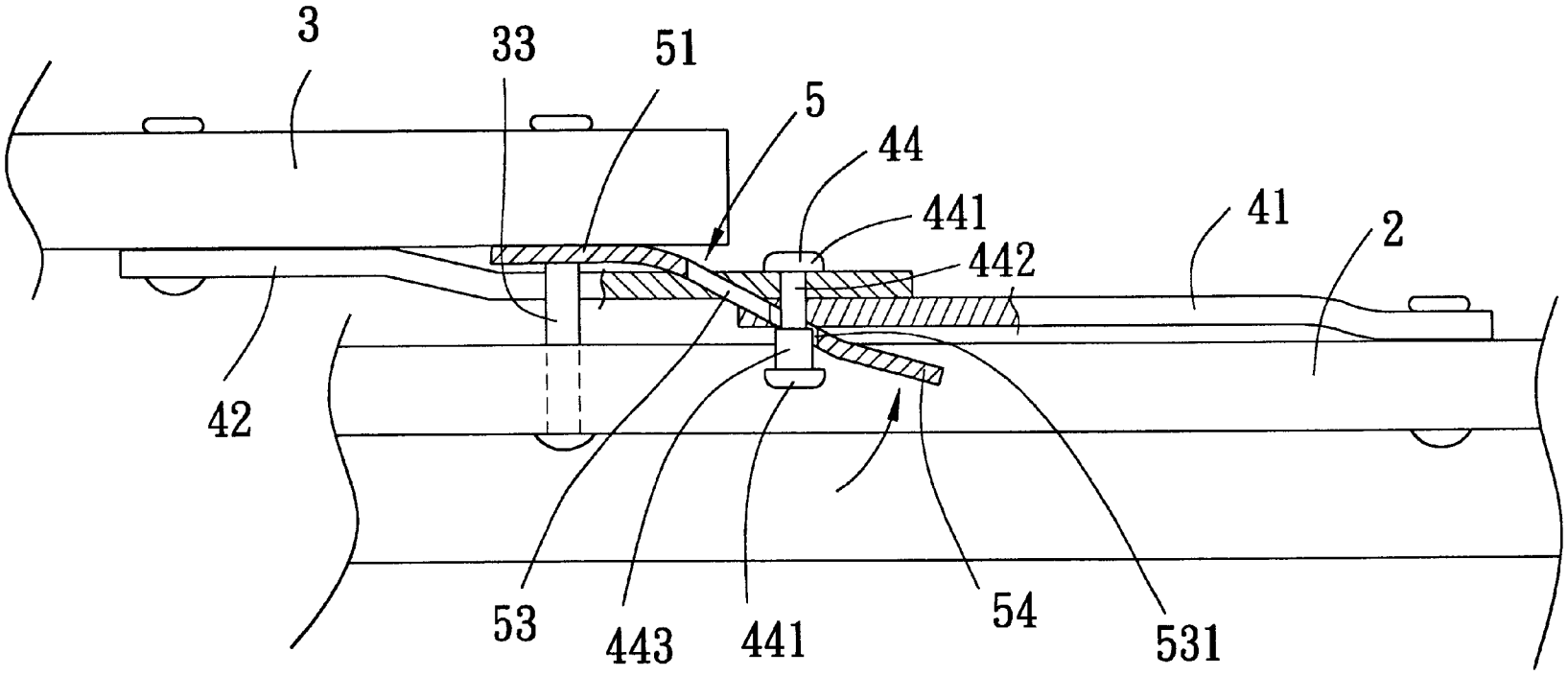
FIG. 6 is a fragmentary, partly sectional view of the preferred embodiment.

The resilient locking plate 5 has a pivoting end portion 51 attached to the upper end 31 of a respective one of the front and rear leg members 3, 3' and formed with a pivot hole 511 which permits extension of a respective one of the front and rear pivot axles 33, 33' therethrough for mounting pivotally the locking plate 5 on the upper end 31 of the respective leg member 3, 3' and on one of the lateral rods 21 of the seat member 2. The resilient locking plate 5 further has an operating end portion 54 opposite to the pivoting end portion 51, and an inclined section 52 which is disposed between the pivoting end portion 51 and the operating end portion 54 and which is formed with an elongated hole 53. The inclined section 5 is inclined relative to the pivoting end portion 51 and the operating end portion 54 so as to dispose the pivoting end portion 51 and the operating end portion 54 in different vertical planes. In the present embodiment, the inclined section 5 extends in a lateral outward direction from the pivoting end portion 51 to the operating end portion 54, as best shown in FIG. 6. The elongated hole 53 has a circular, enlarged hole end 531 proximate to the operating end portion 54.

The locking pin 44 extends through the first and second pivot holes 413, 423 in the first and second linking plates 41, 42, and through the elongated hole 53 in the locking plate 5. The locking pin 44 has two opposite rivet ends 441, one of which is formed by punching after being assembled to the first and second linking plates 41, 42 and the locking plate 5. Between the rivet ends 441, the locking pin 44 further has a thinner pin section 442 slidable along the elongated hole 53, and a wider pin section 443 with a rectangular cross-section wider than the cross-section of the thinner pin section 442 for engaging the enlarged hole end 531 of the elongated hole 53. The wider pin section 443 is disposed laterally outward of and immediately adjacent to the thinner pin section 442.

A pair of the aforementioned conventional linking units 15, 15' are mounted on the other one of the lateral rods 21 of the seat member 2 and the front and rear leg members 3, 3', thereby connecting foldably the front and rear leg members 3, 3' to the seat member 2.

Referring to FIGS. 3, 5 and 6, to unfold the chair frame of the present embodiment, the front leg member 3 is turned forwardly about the front pivot axle 33, and the rear leg member 3' is turned rearwardly about the rear pivot axle 33' to cause the locking pin 44 of each of the front and rear linking units 4, 4' to move in the elongated hole 53 for unfolding the first and second linking plates 41, 42 from each other. After the first and second linking plates 41, 42 are unfolded from each other and are aligned with each other, the stop projection 414 on the lower end 412 of the first linking plate 41 engages the engaging groove 424 in the upper end 421 of the second linking plate 42 to limit further pivoting movement of the first and second linking plates 41, 42 relative to each other. At this time, the wider pin section 443 of the locking pin 44 extends into and engages the enlarged hole end 531 of the elongated hole 53 for locking the first and second linking plates 41, 42 at the unfolded state, thereby locking the respective one of the front and rear leg members 3, 31 at an unfolded state relative to the seat member 2.

Figure 7:
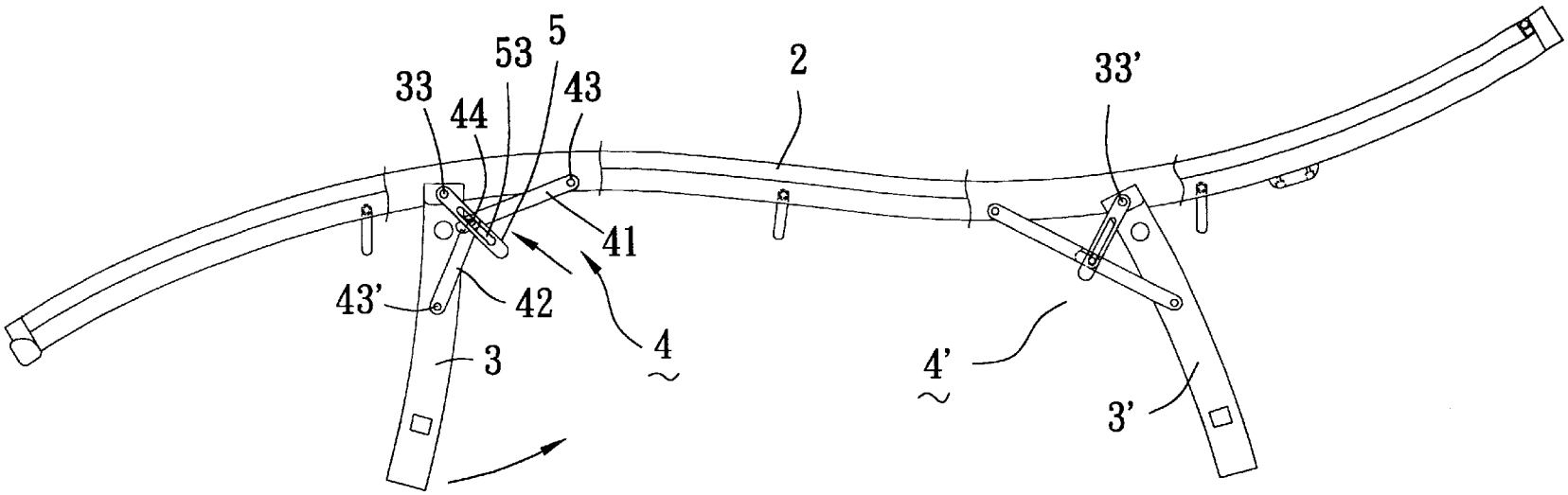
FIG. 7 is a schematic side view illustrating the preferred embodiment during folding operation of a front leg member thereof.

Referring to FIGS. 6 and 7, to fold the front and rear leg members 3 toward the seat member 2, the operating end portion 54 of the locking plate 5 of each of the front and rear linking units 4, 4' is depressed in a lateral inward direction to align the narrower pin section 442 with the enlarged hole end 531, thereby disengaging the wider pin section 443 from the enlarged hole end 531. Thereafter, the locking pin 44 is moved to permit the narrower pin section 442 to slide along the elongated hole 53, thereby resulting in pivoting movement of the first and second linking plates 41, 42 relative to each other for folding toward each other, thus moving the first and second pivot shafts 43, 43' closer to each other for folding the respective one of the front and rear leg members 3, 3' toward the seat member 2.

Accordingly, the locking pin 44 and the locking plate 5 cooperatively constitute a locking unit for locking the respective leg member 3, 31 at the unfolded state relative to the seat member 2. The locking plate 5 can be operated by simply depressing the operating end portion 54 for unlocking the respective leg member 3, 3' from the unfolded state to permit folding of the latter toward the seat member 2.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable chair frame comprising:

a generally horizontal seat member;

a front leg member having an upper end pivoted to said seat member at a horizontal front pivot axis, a lower end adapted to be supported on a ground surface, and an intermediate portion between said upper and lower ends, said front leg member being foldable rearwardly toward said seat member about said front pivot axis;

a rear leg member disposed rearwardly of said front leg member and having an upper end pivoted to said seat member at a horizontal rear pivot axis parallel to said first pivot axis, a lower end adapted to be supported on a ground surface, and an intermediate portion between said upper and lower ends of said rear leg member, said rear leg member being foldable forwardly toward said seat member about said rear pivot axis; and front and rear linking units disposed between said front and rear leg members, each of said front and rear linking units including a first linking plate having an upper end pivoted to said seat frame and a lower end formed with a first pivot hole, a second linking plate having an upper end formed with a second pivot hole aligned with said first pivot hole, and a lower end pivoted to said intermediate portion of a respective one of said front and rear leg members, a resilient locking plate having a pivoting end portion pivoted to said seat member and said upper end of a respective one of said front and rear leg members at a respective one of said front and rear pivot axes, an operating end portion opposite to said pivoting end portion, and an inclined section between said pivoting end portion and said operating end portion and formed with an elongated hole that has an enlarged hole end proximate to said operating end portion, said inclined section being inclined relative to said pivoting end portion and said operating end portion so as to dispose said pivoting end portion and said operating end portion in different vertical planes, and a locking pin extending through said elongated hole in said locking plate and through said first and second pivot holes in said first and second linking plates for interconnecting foldably said first and second linking plates, said locking pin having a thinner pin section slidable along said elongated slot and a wider pin section for engaging said enlarged hole end of said elongated hole, said locking pin being movable in said elongated hole so as to engage said wider pin section of said locking pin with said enlarged hole end of said elongated hole when the respective one of said front and rear leg members is unfolded from said seat member, thereby positioning said first and second linking plates at an unfolded state relative to each other, and thereby positioning the respective one of said front and rear leg members at an unfolded state relative to said seat member, said operating end portion of said locking plate being operable to align said enlarged hole end of said elongated hole with said narrower pin section of said locking pin so as to disengage said wider pin section from said enlarged hole end and to permit movement of said locking pin along said elongated hole for folding said first and second linking plates toward each other, thereby folding the respective one of said front and rear leg members toward said seat member.

2. The foldable chair frame as claimed in claim 1, wherein said inclined section of said locking plate of each of said front and rear linking units extends in a lateral outward direction from said pivoting end portion to said operating end portion, said wider pin section of said locking pin being disposed laterally outward of and immediately adjacent to said thinner pin section, said operating end portion of said locking plate being depressible in a lateral inward direction for disengaging said wider pin section from said enlarged hole end of said elongated hole.

3. The foldable chair frame as claimed in claim 1, wherein said wider pin section of said locking pin of each of said front and rear linking units has a rectangular cross-section, said enlarged hole end of said elongated hole in said locking plate being generally circular for engaging said wider pin section of said locking pin.

4. The foldable chair frame as claimed in claim 1, wherein said resilient locking plate is formed as an elongated metal spring plate.

5. The foldable chair frame as claimed in claim 1, wherein said lower end of said first linking plate of each of said front and rear linking units is formed with a stop projection, said upper end of said second linking plate of each of said front and rear linking units being formed with an engaging groove for engaging said stop projection when said first linking plate is unfolded from said second linking plate to limit further pivoting movement of said first and second linking plates relative to each other.

* * * * *